US009780487B1

(12) United States Patent
Campbell et al.

(10) Patent No.: US 9,780,487 B1
(45) Date of Patent: Oct. 3, 2017

(54) ELECTRICAL CONNECTOR ASSEMBLY WITH AXIAL CONNECTION ASSIST

(71) Applicant: Delphi Technologies, Inc., Troy, MI (US)

(72) Inventors: Jeffrey Scott Campbell, West Bloomfield, MI (US); Wesley W. Weber, Jr., Metamora, MI (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 15/427,725

(22) Filed: Feb. 8, 2017

(51) Int. Cl.
*H01R 13/62* (2006.01)
*H01R 13/629* (2006.01)
*H01R 13/641* (2006.01)

(52) U.S. Cl.
CPC . *H01R 13/62927* (2013.01); *H01R 13/62944* (2013.01); *H01R 13/62955* (2013.01); *H01R 13/641* (2013.01); *H01R 13/6295* (2013.01); *H01R 13/62938* (2013.01); *H01R 13/62972* (2013.01); *H01R 13/62977* (2013.01)

(58) Field of Classification Search
CPC ..... H01R 13/62938; H01R 13/62944; H01R 13/6295; H01R 13/62972; H01R 13/62977
See application file for complete search history.

(56) References Cited

U.S. PATENT DOCUMENTS 3,270,267 A 8/1966 Nolte, Jr.
5,336,934 A 8/1994 Toepfer et al.
5,489,224 A 2/1996 Schwarz
5,564,935 A 10/1996 Yagi et al.
5,944,547 A 8/1999 Golab et al.
5,975,929 A 11/1999 Matsuura et al.
6,428,353 B2 * 8/2002 Mochizuki ..... H01R 13/62933 439/157
6,612,854 B2 * 9/2003 Takata ..... H01R 13/62972 439/157
7,241,155 B2 7/2007 Tyler
7,410,374 B2 * 8/2008 Okuda ..... H01R 13/62955 439/157
7,462,047 B2 12/2008 Tyler
7,744,390 B2 6/2010 Tyler et al.
8,192,212 B2 6/2012 Casses et al.
8,356,999 B2 * 1/2013 Imai ..... H01R 13/62944 439/157
2002/0081877 A1 * 6/2002 Ohnuki ..... H01R 13/62977 439/157

FOREIGN PATENT DOCUMENTS

JP 03285524 A 12/1991

* cited by examiner

*Primary Examiner* — Tho D Ta
(74) *Attorney, Agent, or Firm* — Robert J. Myers

(57) ABSTRACT

A connector includes a first housing, a second housing, a mate assist slider, and a cam gear. The first-housing has a first outer surface. The second housing is configured to mate with the first housing, and the second housing includes a pin extending from a second outer surface. The connector also includes a mate assist slider moveable from an unmated position to a mated position. The connector also includes a cam gear mounted to the first outer surface. The cam gear moves in response to a movement of the mate-assist-slider from the unmated position to the mated position. The cam gear has a cam slot with an inertial detent. A vibratory feedback is provided to an assembler indicative of a properly positioned connector housing when the pin is moved past the inertial detent.

9 Claims, 6 Drawing Sheets

ELECTRICAL CONNECTOR ASSEMBLY WITH AXIAL CONNECTION ASSIST

TECHNICAL FIELD OF INVENTION

This disclosure generally relates to a connector, and more particularly relates to an electrical connector with a mate-assist feature.

BACKGROUND OF INVENTION

It is known to use mate-assist features on electrical connectors used in automotive applications, especially where a higher number of input/output (I/O) connections per system are required due to increased electrical content on the vehicle. Connectors utilizing an integral lever mechanism typically require pre-positioning of the connector prior to closing the lever assist mechanism. This multi-step mating process is cumbersome for assemblers, as these connection systems are not ergonomically friendly and are also prone to mating damage and/or mis-mating. Additionally, because these systems require tools and/or lever motion during mating, additional application package space is required reducing the total number of terminals possible in the connector.

SUMMARY OF THE INVENTION

In accordance with one embodiment, a connector is provided. The connector has a first-housing having a first-outer-surface defining a guide-slot. The connector also includes a second-housing having a second-outer-surface. The second-housing is configured to mate with the first-housing, and the second-housing includes a pin extending from the second-outer-surface. The pin defines a cam-portion and a guide-portion, wherein the guide-portion is configured to engage the guide-slot. The connector also includes a mate-assist-slider moveable from an unmated-position to a mated-position. The mate-assist-slider is longitudinally slideably mounted to and surrounds at least a portion of the first-outer-surface. The mate-assist-slider also includes a gear-rack having rack-teeth. The connector also includes a cam-gear moveably mounted to the first-outer-surface. The cam-gear has gear-teeth that engage the rack-teeth such that the cam-gear moves in response to a movement of the mate-assist-slider from the unmated-position to the mated-position. The cam-gear defines a cam-slot for receiving the cam-portion of the pin. The cam-slot has an entrance having an inertial-detent that covers a portion of the guide-slot and partially blocks a travel-path of the cam-portion of the pin. A vibratory-feedback is provided to an assembler indicative of a properly positioned connector-housing when the pin is moved past the inertial-detent enabling the mate-assist-slider to be moved from the unmated-position to the mated-position.

In another embodiment, a connector is provided. The connector has a first-housing having a first-outer-surface defining a guide-slot. The connector also includes a second-housing having a second-outer-surface. The second-housing is configured to mate with the first-housing, and the second-housing includes a pin extending from the second-outer-surface. The pin defines a cam-portion and a guide-portion, wherein the guide-portion is configured to engage the guide-slot. The connector also includes a mate-assist-slider moveable from an unmated-position to a mated-position. The mate-assist-slider is longitudinally slideably mounted to and surrounds at least a portion of the first-outer-surface. The mate-assist-slider also includes a gear-rack having rack-teeth. The connector also includes a cam-gear moveably mounted to the first-outer-surface. The cam-gear has gear-teeth that engage the rack-teeth such that the cam-gear moves in response to a movement of the mate-assist-slider from the unmated-position to the mated-position. The cam-gear defines a cam-slot for receiving the cam-portion of the pin. The cam-slot has an entrance and a stop. The cam-gear further defines a pivot-hole configured to movably mount the cam-gear on a pivot-pin of the first-housing. The pivot-hole defines an opening, wherein a portion of the pivot-hole is in communication with the cam-slot. When the mate-assist-slider is moved from the unmated-position to the mated-position the pin is axially pulled to the stop thereby mating the second-housing with the first-housing such that the pin and the pivot-pin are spaced less than 0.7 millimeters apart at the opening.

In yet another embodiment, a connector is provided. The connector includes a first-housing having a first-outer-surface defining a guide-slot. The connector also includes a second-housing having a second-outer-surface, wherein the second-housing is configured to mate with the first-housing. The second-housing includes a pin extending from the second-outer-surface. The pin defines a cam-portion and a guide-portion where the guide-portion is configured to engage the guide-slot. The connector also includes a mate-assist-slider moveable from an unmated-position to a mated-position. The mate-assist-slider is longitudinally slideably mounted to and surrounds at least a portion of the first-outer-surface. The mate-assist-slider includes a gear-rack having rack-teeth. The connector also includes a cam-gear moveably mounted to the first-outer-surface. The cam-gear has gear-teeth that engage the rack-teeth such that the cam-gear moves in response to a movement of the mate-assist-slider from the unmated-position to the mated-position. The cam-gear defines a cam-slot for receiving the cam-portion of the pin. The cam-gear includes a locking-tab configured to prevent the movement of the cam-gear and the mate-assist-slider until an unlock-rib extending from the second-housing disengages the locking-tab as the second-housing is mated with the first-housing.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 1:
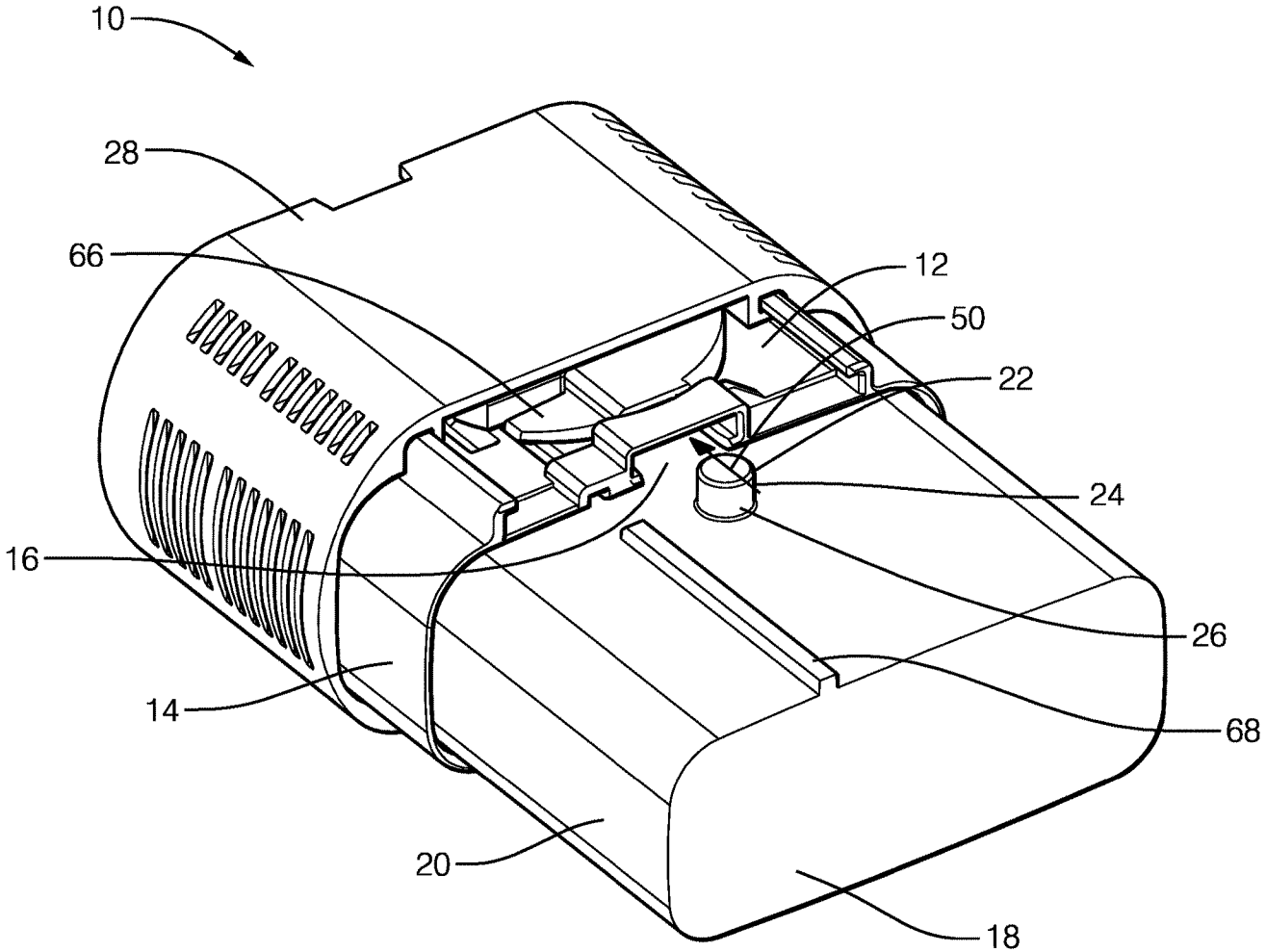
FIG. 1 is an illustration of a connector with a mate-assist-slider in accordance with one embodiment.

FIG. 1 illustrates a non-limiting example of a connector 10, with a mate-assist-device. The connector 10 includes a first-housing 12 that has a first-outer-surface 14 that defines a guide-slot 16. The first-housing 12 may have multiple electrical terminals (not shown) that may attach to a wire-bundle (not shown) that may connect to wire-harness or other electrical-components. The first-housing 12 may also include wire seals and strain relief for the wires (not shown).

The connector 10 also includes a second-housing 18 having a second-outer-surface 20 wherein the second-housing 18 is configured to removably mate with the first-housing 12. The second-housing 18 may also have multiple corresponding electrical terminals (not shown) configured to mate with the electrical terminals of the first-housing 12 that may attach to a wire-bundle that may connect to wire-harness or other electrical-components (not shown). The second-housing 18 may also include wire seals and strain relief for the wires, and a perimeter seal (not shown) to form a seal with the first-housing 12. The second-housing 18 includes a pin 22 extending from the second-outer-surface 20. The pin 22 defines both a cam-portion 24 and a guide-portion 26. The guide-portion 26 of the pin 22 is configured to engage and slide along the guide-slot 16 in the first-housing 12 to ensure that the first-housing 12 and the second-housing 18 are properly aligned prior to mating.

Figure 2A:
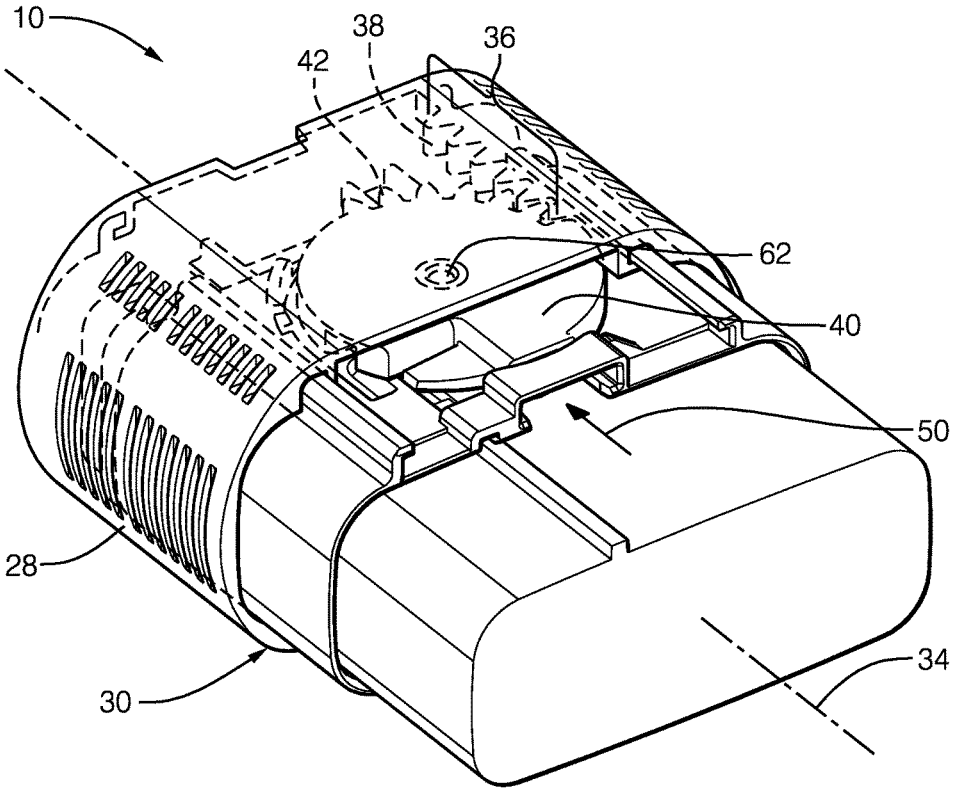
FIG. 2A is an illustration of a transparent view of the mate-assist-slider in an unmated-position of the connector of FIG. 1 in accordance with the invention.
Figure 2B:
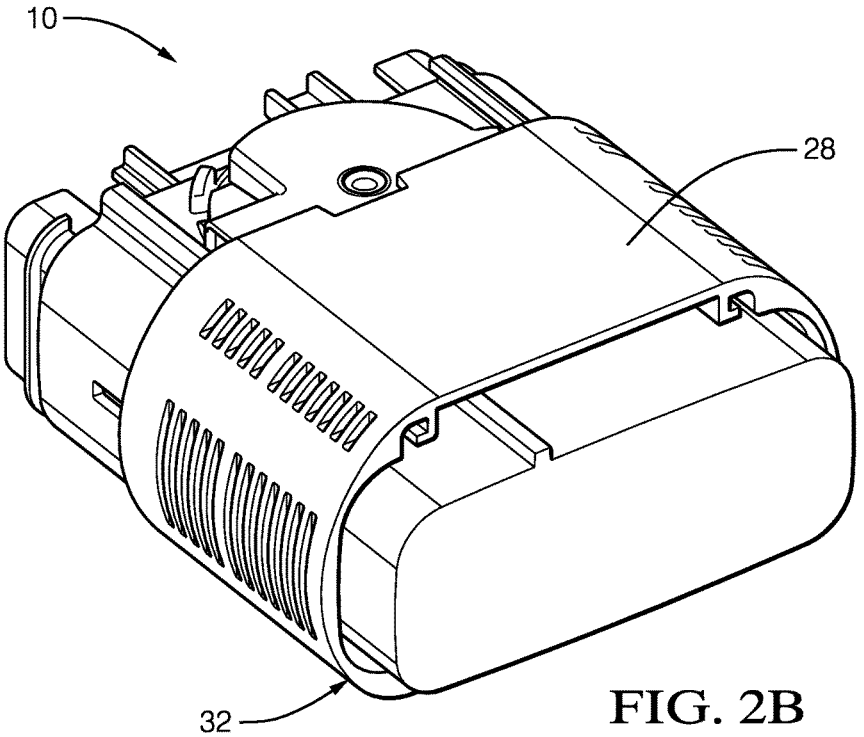
FIG. 2B is an illustration of the connector of FIG. 2A with the mate-assist-slider in a mated-position in accordance with the invention.

The connector 10 also includes a mate-assist-slider 28 (see FIG. 1) that is moveable from an unmated-position 30 (see FIG. 2A) to a mated-position 32 (see FIG. 2B).

As illustrated in FIG. 2A, the mate-assist-slider 28 is longitudinally slideably mounted to the first-outer-surface 14 and is configured to move in a direction parallel to a longitudinal-axis 34 of the connector 10. The mate-assist-slider 28 surrounds a portion of the first-outer-surface 14 and includes a gear-rack 36 having rack-teeth 38 that are configured to engage a cam-gear 40.

Figure 3B:
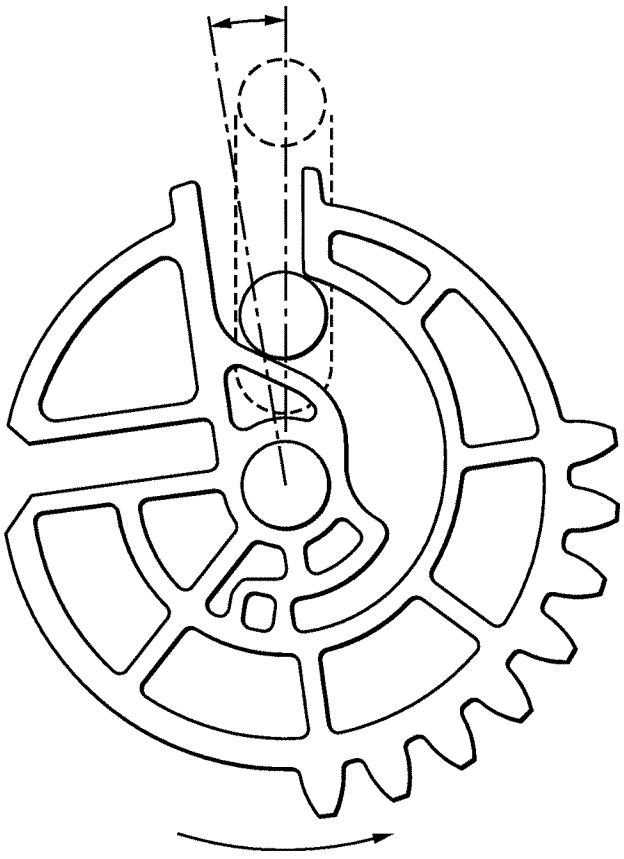
FIG. 3B is an illustration of a prior-art cam-gear in accordance with the prior art.
Figure 3A:
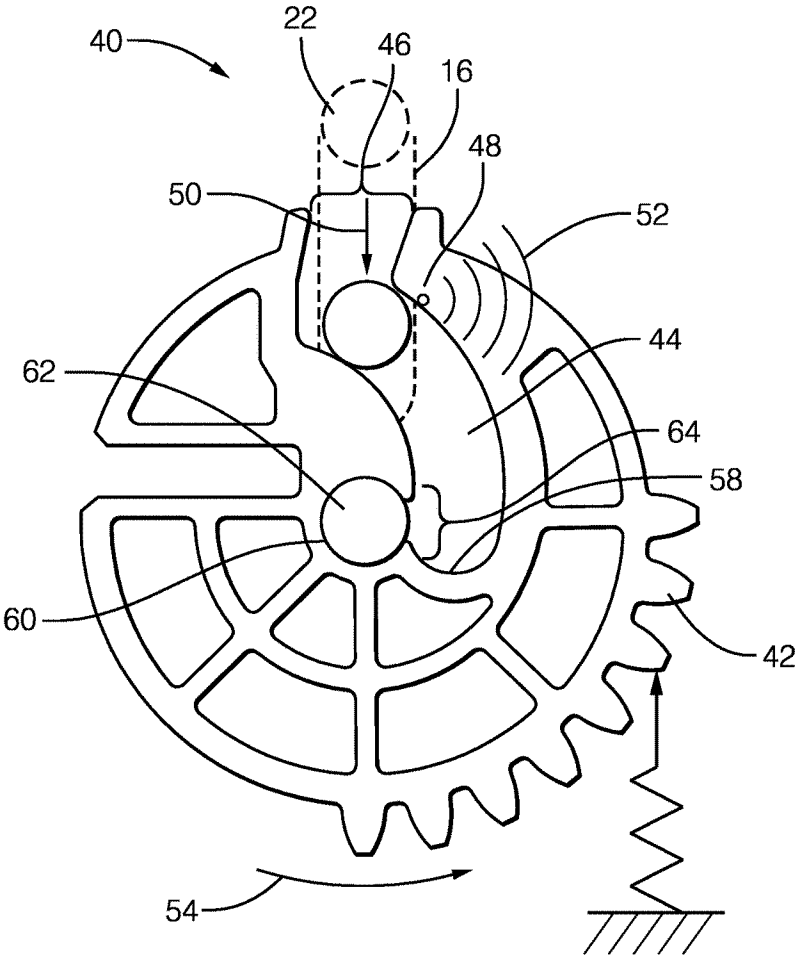
FIG. 3A is an illustration of a cam-gear in accordance with one embodiment.
Figure 6:
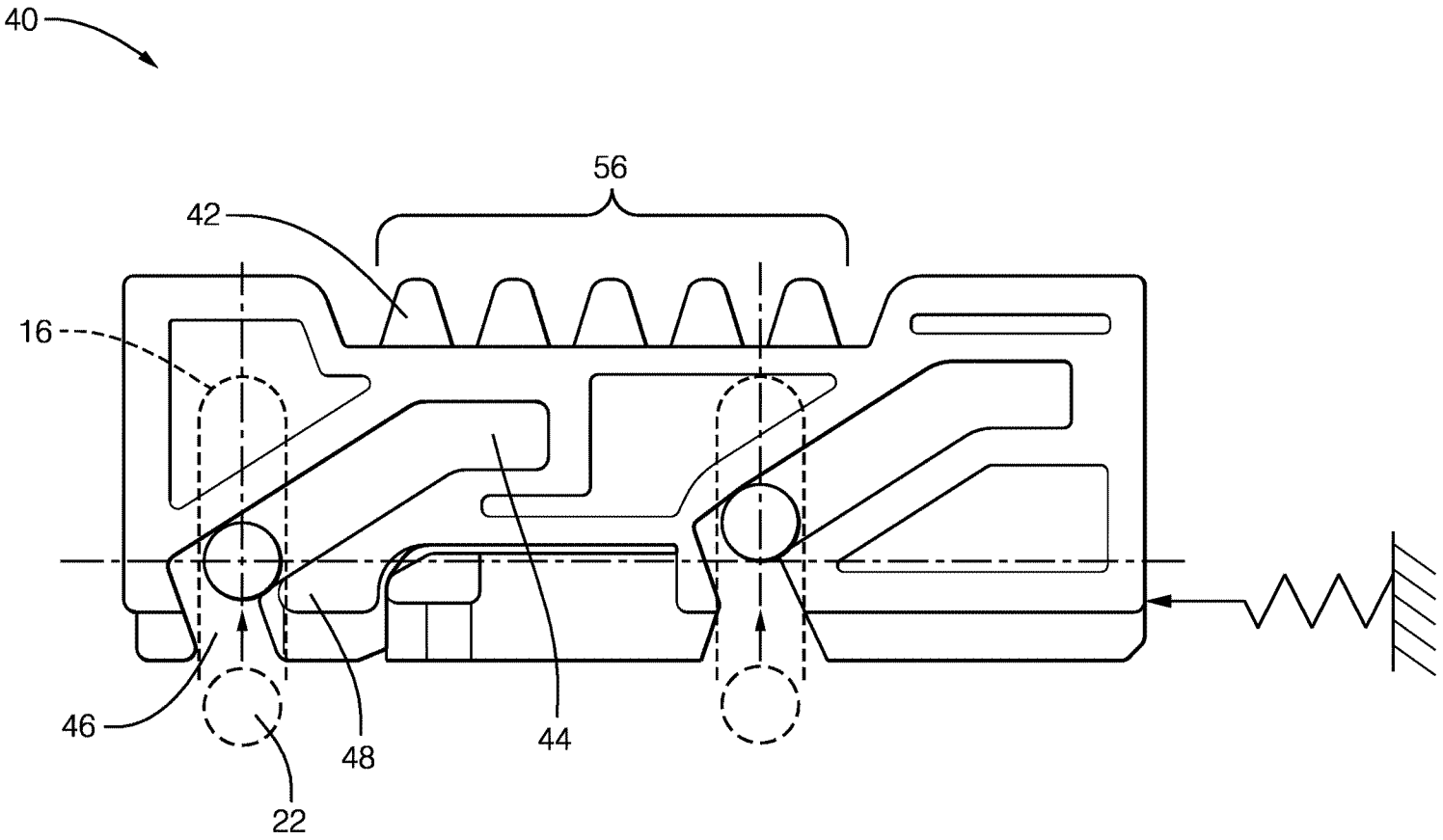
FIG. 6 is an illustration of a cam-gear in accordance with one embodiment.

The connector 10 also includes the cam-gear 40 that is rotatably mounted to the first-outer-surface 14 as illustrated in FIG. 2A. The cam-gear 40 has gear-teeth 42 that engage the rack-teeth 38 such that the cam-gear 40 moves in response to a movement of the mate-assist-slider 28 from the unmated-position 30 to the mated-position 32. The cam-gear 40 defines a cam-slot 44 (see FIG. 3A) for receiving the cam-portion 24 of the pin 22. The cam-slot 44 has an entrance 46 that includes an inertial-detent 48. The inertial-detent 48 covers a portion of the guide-slot 16 by extending over the guide-slot 16 and partially blocks a travel-path 50 of the cam-portion 24 of the pin 22. When the pin 22 is moved past the inertial-detent 48 a vibratory-feedback 52 is provided to an assembler that is indicative of a properly positioned connector-housing. The properly positioned connector-housing enables the mate-assist-slider 28 to be moved from the unmated-position 30 to the mated-position 32. The vibratory-feedback 52 may manifest itself as an audible and/or a tactile feedback to the assembler. The inertial-detent 48 may deflect by flexing the cam-gear 40 and return to a home-position (not specifically shown) as the pin 22 is moved past the inertial-detent 48 due to an external spring, or preferably through an internal spring-force resulting from the inherent flexure of the connector 10 components (FIG. 3A). The inertial-detent 48 is beneficial over the prior art (FIG. 3B) because the prior art requires the assembler to align the connector-housings then rotate the cam-gear 40 to capture the pin 22 in the cam-slot 44, a process that is cumbersome and ergonomically disadvantageous. FIG. 3A illustrates one embodiment where the gear-teeth 42 of the cam-gear 40 are aligned along a curved-path 54. The gear-teeth 42 may also be aligned along a straight-path 56, as illustrated in FIG. 6.

Figure 4B:
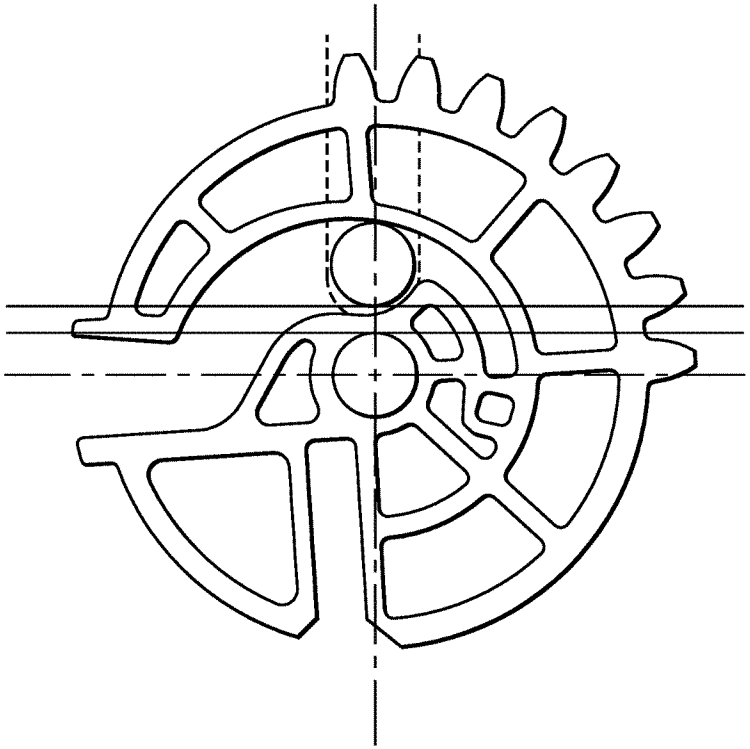
PRIOR ART FIG. 4B
FIG. 4B is an illustration of a prior-art cam-gear in accordance with the prior art.
Figure 4A:
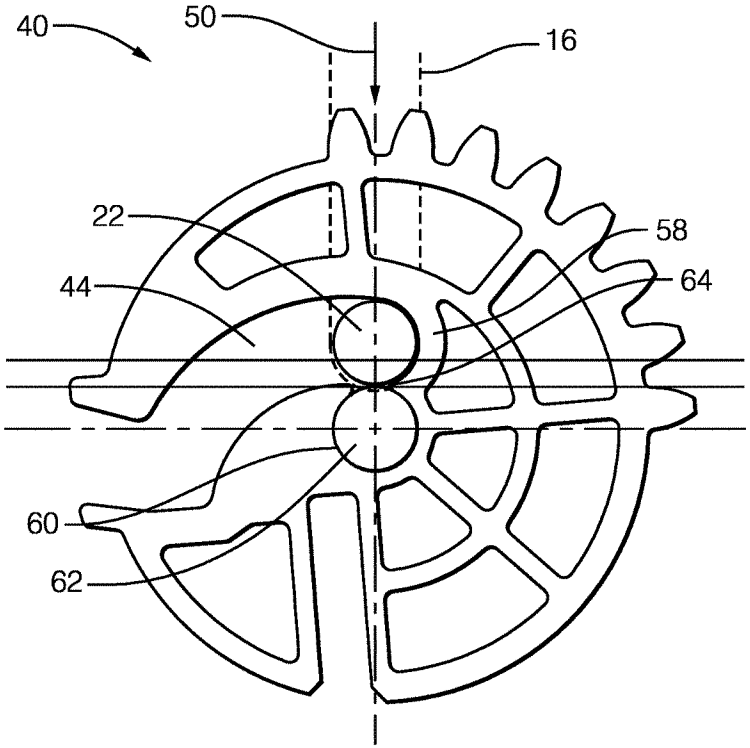
FIG. 4A is an illustration of a cam-gear in accordance with one embodiment.

The connector 10 may also include the cam-gear 40 wherein the cam-gear 40 further defines a stop 58 and a pivot-hole 60 (FIG. 3A) configured to moveably mount the cam-gear 40 on a pivot-pin 62 extending from the first-housing 12. The pivot-hole 60 further defines an opening 64 wherein a portion of the pivot-hole 60 is in communication with the cam-slot 44. As illustrated in FIG. 4A, when the cam-gear 40 is moved the pin 22 is axially pulled to the stop 58 such that the pin 22 and the pivot-pin 62 are spaced less than 0.7 millimeters apart at the opening 64. This results in an increase of axial displacement of the mating housings by 22% over the prior art illustrated in FIG. 4B.

Figure 5A:
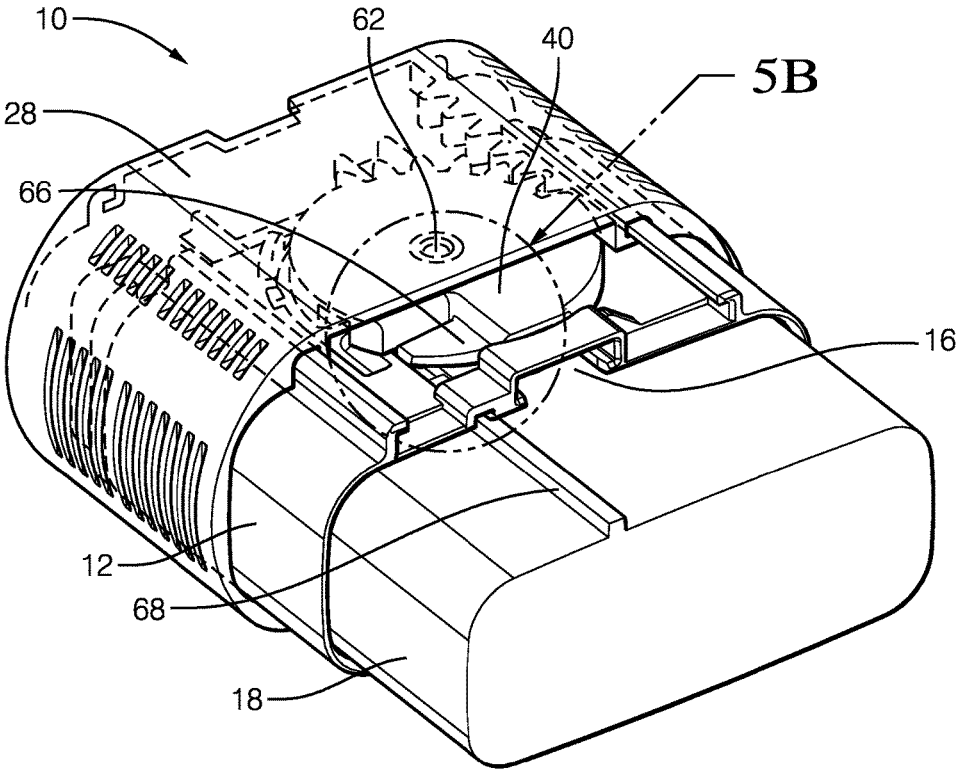
FIG. 5A is an illustration of a connector with a locking-tab in accordance with one embodiment.
Figure 5B:
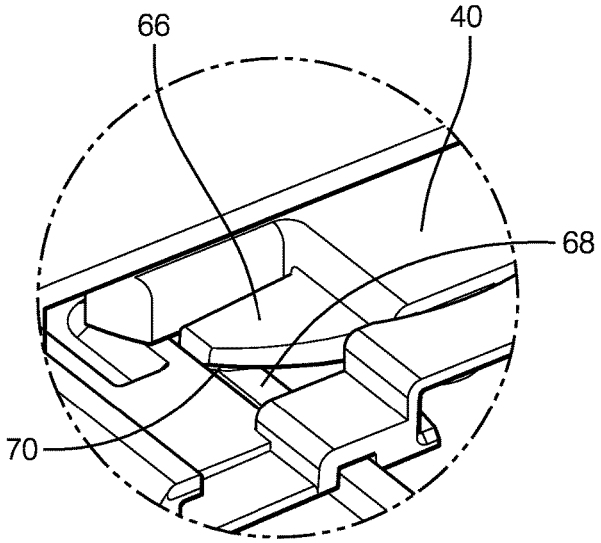
FIG. 5B is an illustration the connector of FIG. 5A with a locking-tab in accordance with the invention.

The connector 10 may also include the cam-gear 40 that includes a locking-tab 66 as illustrated in FIG. 5A and FIG. 5B. The locking-tab 66 is configured to prevent the movement of the cam-gear 40 and the mate-assist-slider 28 until an unlock-rib 68 extending from the second-housing 18 disengages 70 the locking-tab 66 as the second-housing 18 is mated with the first-housing 12. The locking-tab 66 is beneficial because it enables the assembler to properly align the first-housing 12 with the second-housing 18 without moving the mate-assist-slider 28, thereby keeping the entrance 46 of the cam-slot 44 in the proper position to accept the pin 22.

The examples presented herein are directed to electrical connector systems. However, other embodiments of the connector system may be envisioned that are adapted for use with optical cables or hybrid connections including both electrical and optical cables. Yet other embodiments of the connector system may be envisioned that are configured for connecting pneumatic or hydraulic lines.

Accordingly, a connector 10 that includes a mate-assist feature is provided. The connector 10 is an improvement over prior-art-connectors because to provides the assembler with a vibratory-feedback 52 that may be tactile and/or audible and is indicative of a properly positioned connector-housing. The connector 10 also increases the axial displacement of the mating housings compared to prior-art-connectors.

While this invention has been described in terms of the preferred embodiments thereof, it is not intended to be so limited, but rather only to the extent set forth in the claims that follow.

We claim:

1. A connector, comprising:

a first-housing having a first-outer-surface defining a guide-slot;

a second-housing having a second-outer-surface, wherein the second-housing is configured to mate with the first-housing, said second-housing including a pin extending from the second-outer-surface, said pin defining a cam-portion and a guide-portion, wherein the guide-portion is configured to engage the guide-slot;

a mate-assist-slider moveable from an unmated-position to a mated-position, said mate-assist-slider longitudinally slideably mounted to and surrounding at least a portion of the first-outer-surface, said mate-assist-slider including a gear-rack having rack-teeth; and a cam-gear moveably mounted to the first-outer-surface, said cam-gear having gear-teeth that engage the rack-teeth such that the cam-gear moves in response to a movement of the mate-assist-slider from the unmated-position to the mated-position, said cam-gear defining a cam-slot for receiving the cam-portion of the pin wherein the cam-slot has an entrance having an inertial-detent that covers a portion of the guide-slot and partially blocks a travel-path of the cam-portion of the pin, such that a vibratory-feedback is provided to an assembler indicative of a properly positioned connector-housing when the pin is moved past the inertial-detent enabling the mate-assist-slider to be moved from the unmated-position to the mated-position.

2. The connector in accordance with claim 1, wherein the gear-teeth of the cam-gear are aligned along a curved-path.

3. The connector in accordance with claim 1, wherein the gear-teeth of the cam-gear are aligned along a straight-path.

4. The connector in accordance with claim 1, wherein the cam-slot of the cam-gear further defines a stop, and wherein the cam-gear further defines a pivot-hole configured to movably mount the cam-gear on a pivot-pin of the first-housing, said pivot-hole defining an opening wherein a portion of the pivot-hole is in communication with the cam-slot, and wherein when the cam-gear is moved the pin is axially pulled to the stop such that the pin and the pivot-pin are spaced less than 0.7 millimeters apart at the opening.

5. The connector in accordance with claim 1, wherein the cam-gear includes a locking-tab, said locking-tab configured to prevent the movement of the cam-gear and the mate-assist-slider until an unlock-rib extending from the second-housing disengages the locking-tab as the second-housing is mated with the first-housing.

6. A connector, comprising:

a first-housing having a first-outer-surface defining a guide-slot;

a second-housing having a second-outer-surface, wherein the second-housing is configured to mate with the first-housing, said second-housing including a pin extending from the second-outer-surface, said pin defining a cam-portion and a guide-portion, wherein the guide-portion is configured to engage the guide-slot;

a mate-assist-slider moveable from an unmated-position to a mated-position, said mate-assist-slider longitudinally slideably mounted to and surrounding at least a portion of the first-outer-surface, said mate-assist-slider including a gear-rack having rack-teeth; and a cam-gear moveably mounted to the first-outer-surface, said cam-gear having gear-teeth that engage the rack-teeth such that the cam-gear moves in response to a movement of the mate-assist-slider from the unmated-position to the mated-position, said cam-gear defining a cam-slot for receiving the cam-portion of the pin wherein the cam-slot has an entrance and a stop, said cam-gear further defining a pivot-hole configured to movably mount the cam-gear on a pivot-pin of the first-housing, said pivot-hole defining an opening, wherein a portion of the pivot-hole is in communication with the cam-slot and wherein when the mate-assist-slider is moved from the unmated-position to the mated-position the pin is axially pulled to the stop thereby mating the second-housing with the first-housing such that the pin and the pivot-pin are spaced less than 0.7 millimeters apart at the opening.

7. The connector in accordance with claim 6, wherein the gear-teeth of the cam-gear are aligned along a curved-path.

8. The connector in accordance with claim 6, wherein the cam-gear includes a locking-tab, said locking-tab configured to prevent the movement of the cam-gear until an unlock-rib extending from the second-housing disengages the locking-tab as the second-housing is mated with the first-housing.

9. A connector, comprising:

a first-housing having a first-outer-surface defining a guide-slot;

a second-housing having a second-outer-surface, wherein the second-housing is configured to mate with the first-housing, said second-housing including a pin extending from the second-outer-surface, said pin defining a cam-portion and a guide-portion, wherein the guide-portion is configured to engage the guide-slot;

a mate-assist-slider moveable from an unmated-position to a mated-position, said mate-assist-slider longitudinally slideably mounted to and surrounding at least a portion of the first-outer-surface, said mate-assist-slider including a gear-rack having rack-teeth; and a cam-gear moveably mounted to the first-outer-surface, said cam-gear having gear-teeth that engage the rack-teeth such that the cam-gear moves in response to a movement of the mate-assist-slider from the unmated-position to the mated-position, said cam-gear defining a cam-slot for receiving the cam-portion of the pin, wherein the cam-gear includes a locking-tab, said locking-tab configured to prevent the movement of the cam-gear and the mate-assist-slider until an unlock-rib extending from the second-housing disengages the locking-tab as the second-housing is mated with the first-housing.

* * * * *